US007290697B1

(12) United States Patent
Lessard

(10) Patent No.: US 7,290,697 B1
(45) Date of Patent: Nov. 6, 2007

(54) MAILBOX SUPPORT STRUCTURE DEVICE, KIT AND METHOD

(76) Inventor: Kevin R. Lessard, 173 Temple Ave., Old Orchard Beach, ME (US) 04064

( * ) Notice: Subject to any disclaimer, the term of this patent is extended or adjusted under 35 U.S.C. 154(b) by 0 days.

(21) Appl. No.: 10/828,861

(22) Filed: Apr. 21, 2004

(51) Int. Cl.
*A45F 3/44* (2006.01)

(52) U.S. Cl. ..... 232/39; 248/124.1; 248/161; 248/354.5; 248/156; 232/39

(58) Field of Classification Search ..... 403/109.6; 248/124.1, 161, 156, 354.5; 232/39
See application file for complete search history.

(56) References Cited

U.S. PATENT DOCUMENTS

| | | | | |
|---|---|---|---|---|
| 1,587,920 | A | 6/1926 | Pixler | |
| 1,685,445 | A * | 9/1928 | Bash | 248/407 |
| 3,229,940 | A * | 1/1966 | Kagels | 248/124.1 |
| 3,497,078 | A * | 2/1970 | Nash | 211/79 |
| 3,833,168 | A | 9/1974 | Sackrison | |
| 3,870,262 | A | 3/1975 | Manning, jr. | |
| 4,286,747 | A | 9/1981 | Deike | |
| 4,858,876 | A | 8/1989 | Moreno | |
| 5,259,821 | A * | 11/1993 | Bryant | 474/136 |
| 5,524,858 | A | 6/1996 | Friend | |
| D390,329 | S | 2/1998 | Riley | |
| 5,873,552 | A * | 2/1999 | Skarp | 248/161 |
| 5,979,854 | A * | 11/1999 | Lundgren et al. | 248/354.3 |
| 6,435,801 | B2 * | 8/2002 | Talbott | 414/462 |

* cited by examiner

*Primary Examiner*—Amy J. Sterling
*Assistant Examiner*—Timothy S. Smith

(57) ABSTRACT

A mailbox support structure device, an associated kit and method of using same are disclosed. The mailbox support structure device includes the interconnected components of a telescoping vertical post member, a telescoping horizontal post member and a pair of locking pins. The mailbox support structure device may be lengthened horizontally and vertically to overcome snow piling up at or near the device. The kit includes the unassembled components of the device. The method of using same includes the steps of adjoining, affixing, boring, cutting, digging, drilling, enlarging, expanding, inserting, locking, obtaining, piercing, placing, pouring, screwing, and slipping.

14 Claims, 4 Drawing Sheets

MAILBOX SUPPORT STRUCTURE DEVICE, KIT AND METHOD

FIELD OF THE INVENTION

The present invention relates to the art of mailboxes, more particularly to a mailbox support structure device, an associated kit and a method of using same.

BACKGROUND OF THE INVENTION

Mailbox supports mounted alongside roadways have been overlooked as requiring adjustable horizontal and vertical dimensions. Particularly, in winter, when snow drifts line the roads, roadside mailboxes and particularly their supporting structures are often broken when the overhanging mailboxes are struck by snow plows and other vehicles. Mailboxes of this type ordinarily are mounted at the end of a horizontal arm which in turn is attached to a post anchored in the ground adjacent to the road edge, and such rigid supporting structures suffer heavily when mailboxes are struck by vehicles.

A wide variety of mailbox support structures is currently available on the commercial market and an even larger number of these types of devices are known in the art of mailbox support structures, for example, the adjustable mail box support disclosed by Pixler in U.S. Pat. No. 1,587,920; the mailbox stand disclosed by Nash in U.S. Pat. No. 3,497,078; the mail box with height adjustable support means disclosed by Sackrison in U.S. Pat. No. 3,833,168; the swingable, demountable mailbox support disclosed by Manning, Jr. in U.S. Pat. No. 3,870,262; the mail box support disclosed by Deike in U.S. Pat. No. 4,286,747; the post support disclosed by Moreno in U.S. Pat. No. 4,858,876; the support arrangement disclosed by Friend in U.S. Pat. No. 5,524,858; and the mailbox support and post disclosed by Riley in U.S. Pat. No. D390,329.

While all of the above-described devices fulfill their respective, particular objectives and requirements, the aforementioned patents do not describe a mailbox support structure device having the interconnected components of a telescoping vertical post member, a telescoping horizontal post member and a pair of locking pins. This combination of elements would specifically match the user's particular individual needs of making it possible to conveniently lengthened both the horizontal and vertical telescoping posts in order to overcome snow piling up at or near the device. The above-described patents make no provision for mailbox support structure device having the interconnected components of a telescoping vertical post member, a telescoping horizontal post member and a pair of locking pins.

Therefore, a need exists for a new and improved mailbox support structure device having the interconnected components of a telescoping vertical post member, a telescoping horizontal post member and a pair of locking pins. In this respect, the mailbox support structure device according to the present invention substantially departs from the conventional concepts and designs of the prior art, and in doing so provides an apparatus primarily developed for the purpose of providing a convenient means for lengthened both the horizontal and vertical telescoping posts in order to overcome snow piling up at or near the device.

SUMMARY OF THE INVENTION

The present device, kit and method of using, according to the principles of the present invention, overcomes the shortcomings of the prior art by providing a novel and nonobvious mailbox support structure device, kit and method of using the same. The mailbox support structure device includes the interconnected components of a telescoping vertical post member, a telescoping horizontal post member and a pair of locking pins. The mailbox support structure device may be lengthened horizontally and vertically to overcome snow piling up at or near the device. The kit includes the unassembled components of the device. The method of using same includes the steps of adjoining, affixing, boring, cutting, digging, drilling, enlarging, expanding, inserting, locking, obtaining, piercing, placing, pouring, screwing, and slipping.

In view of the foregoing disadvantages inherent in the known type mailbox devices now present in the prior art, the present invention provides an improved mailbox support structure device, which will be described subsequently in great detail, is to provide a new and improved mailbox support structure device which is not anticipated, rendered obvious, suggested, or even implied by the prior art, either alone or in any combination thereof.

To attain this, the present invention essentially comprises the interconnected components of a telescoping vertical post member, a telescoping horizontal post member and a pair of locking pins. The mailbox support structure device may be lengthened horizontally and vertically to overcome snow piling up at or near the device.

There has thus been outlined, rather broadly, the more important features of the invention in order that the detailed description thereof that follows may be better understood, and in order that the present contribution of the art may be better appreciated.

The invention may also include a pair of locks. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved mailbox support structure device that has all the advantages of the prior art mailbox support structure device and none of the disadvantages.

It is another object of the present invention to provide a new and improved mailbox support structure device that may be easily and efficiently manufactured and marketed.

An even further object of the present invention is to provide a new and improved mailbox support structure device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new mailbox support structure device that provides in the apparatuses and methods of the prior art some of the advantages thereof, while simultaneously overcoming some of the disadvantages normally associated therewith.

Even still another object of the present invention is to provide a mailbox support structure device having the interconnected components of a telescoping vertical post member, a telescoping horizontal post member and a pair of locking pins. This combination of elements makes it possible to conveniently lengthened both the horizontal and vertical telescoping posts in order to overcome snow piling up at or near the device.

Still another object of the present invention is to provide a kit comprising the unassembled components of the device.

Lastly, it is an object of the present invention to provide a new and improved method of using comprising the steps of adjoining, affixing, boring, cutting, digging, drilling, enlarging, expanding, inserting, locking, obtaining, piercing, placing, pouring, screwing, and slipping.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
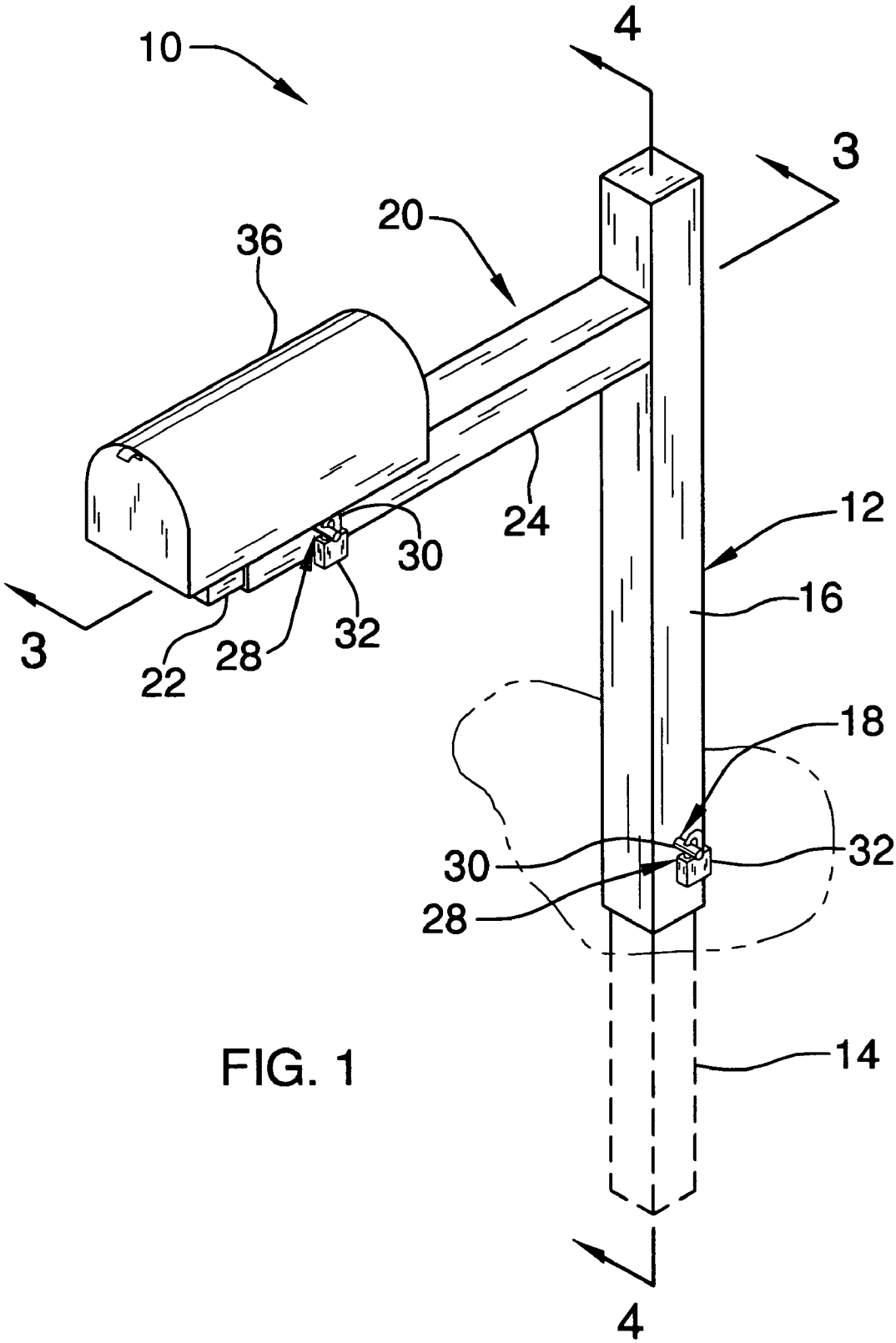
FIG. 1 is a perspective view of an preferred embodiment of the mailbox support structure device constructed in accordance with the principles of the present invention.
Figure 2:
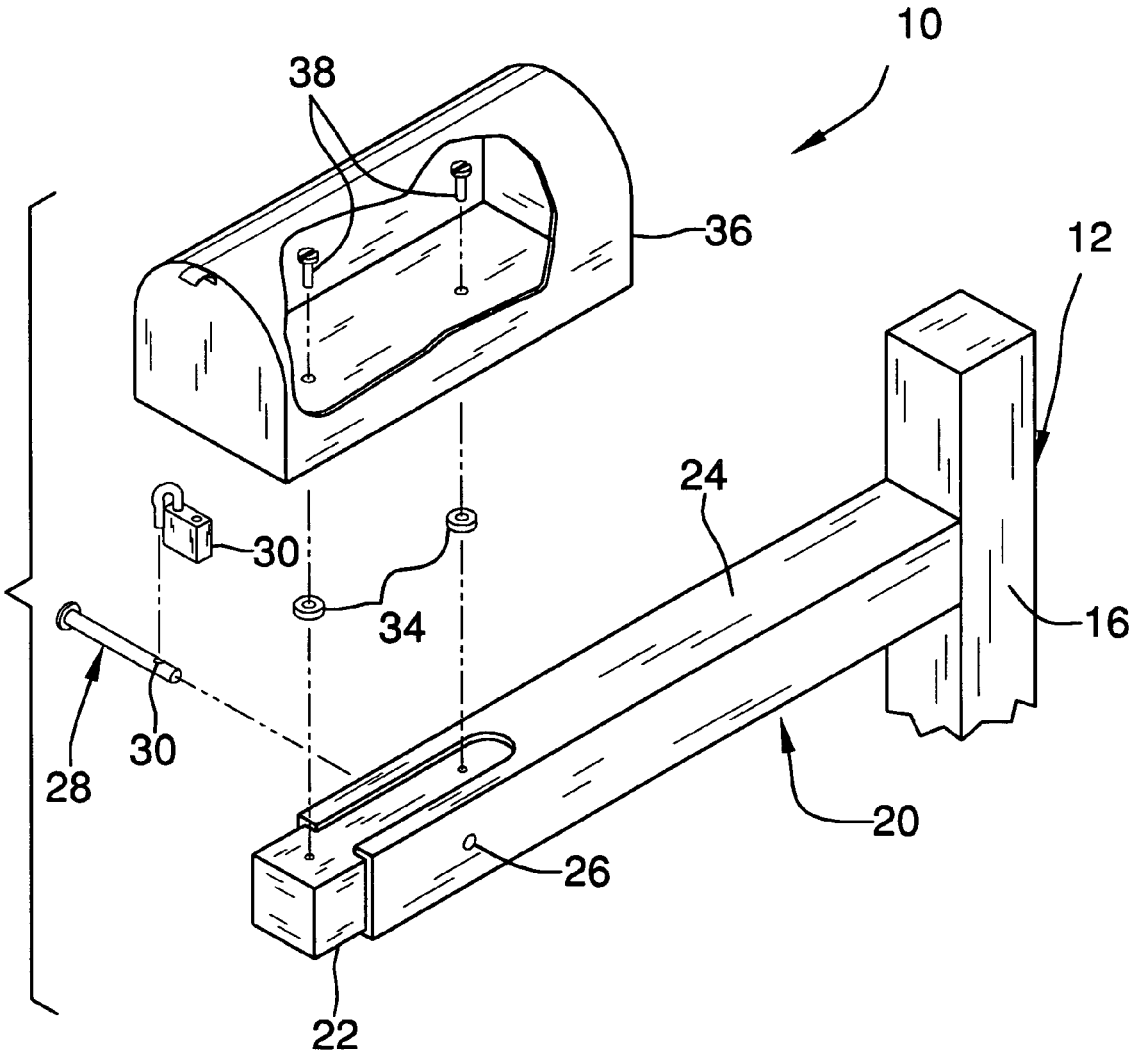
FIG. 2 is a perspective exploded view of a partial cross section of a preferred embodiment of the mailbox support structure device of the present invention.
Figure 3:
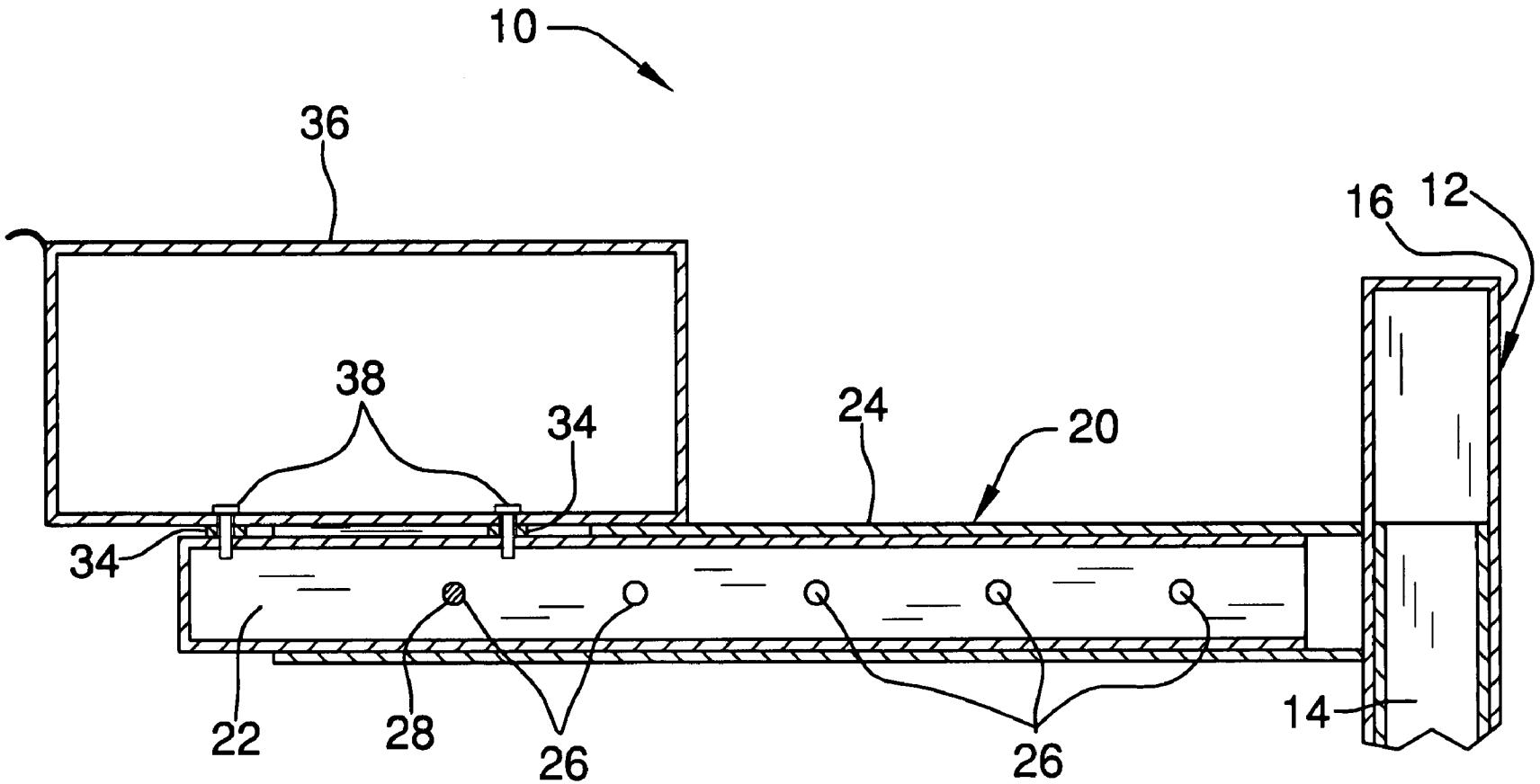
FIG. 3 is a cross sectional side view of a portion of the preferred embodiment of the mailbox support structure device of the present invention.
Figure 4:
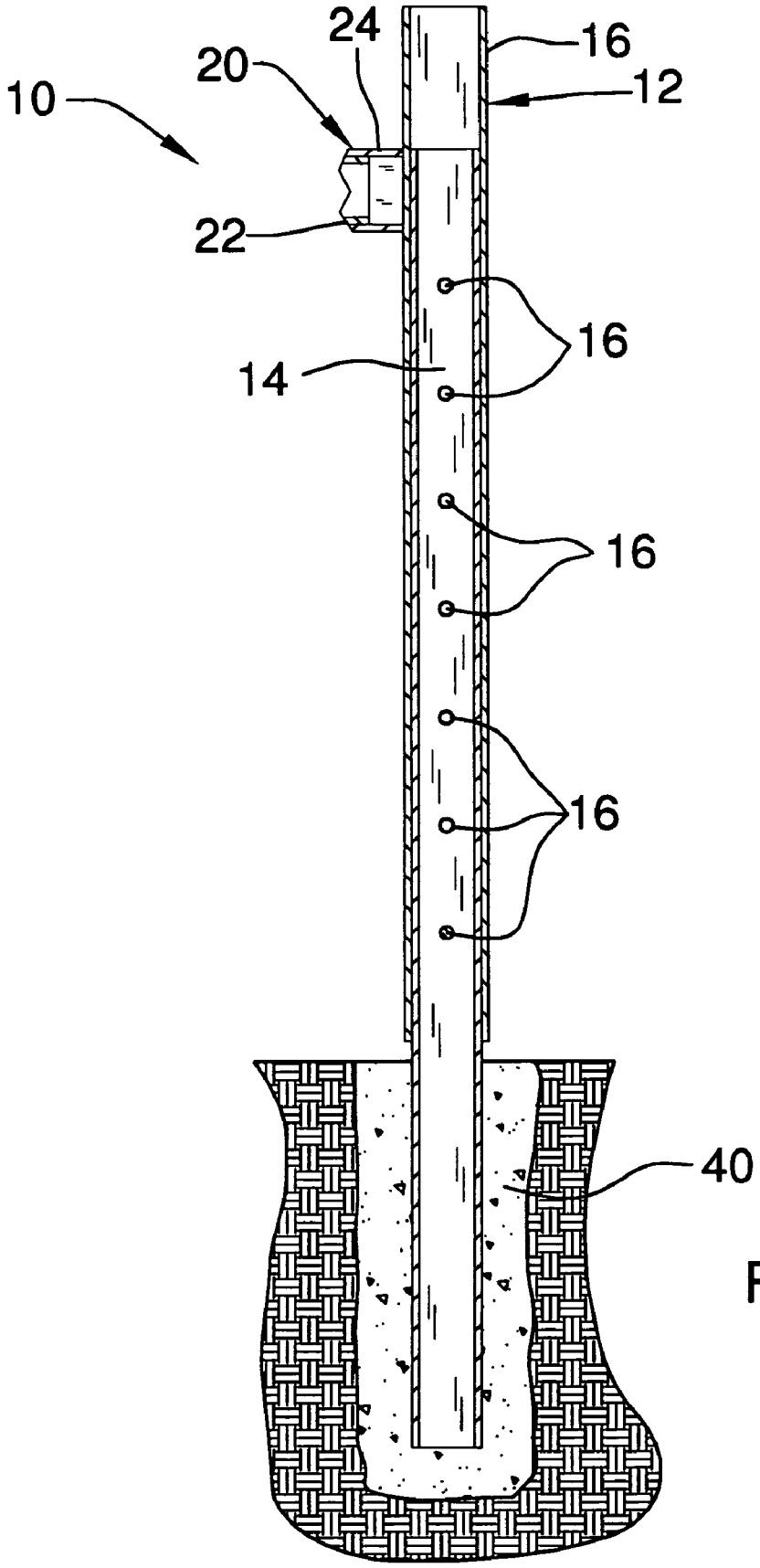
FIG. 4 is a cross sectional side view of a portion of the preferred embodiment of the mailbox support structure device of the present invention.

Referring now to the drawings, and in particular FIGS. 1 to 4 thereof, one preferred embodiment of the present invention is shown and generally designated by the reference numeral 10. One preferred embodiment of a mailbox support structure device 10 comprising: a telescoping vertical post member 12, a telescoping horizontal post member 20, and a pair of locking pins 28. The telescoping vertical post member 12 has an inner part 14 slidably engaged with an outer part 16, wherein the telescoping vertical post member 12 has a plurality of holes 18 traversing entirely through the inner part 14 and has at least one hole 18 traversing entirely through the outer part 16 of the telescoping vertical post member 12. The telescoping horizontal post member 20 is attached to the telescoping vertical post member 12, in which the telescoping horizontal post member 20 has an inner piece 22 slidably engaged with an outer piece 24, wherein the telescoping horizontal post member 20 has a plurality of orifices 26 traversing entirely through the inner and has at least one orifice 26 traversing entirely through the outer piece 24 of the telescoping horizontal post member 20. One of the locking pins 28 is slidably engaged with the hole 18 of the outer part 16 of the telescoping vertical post member 12 and slidably engaged with anyone hole 18 of the plurality of holes 18 in the inner part 14 of the telescoping vertical post member 12. Another of the locking pins 28 is slidably engaged with the orifice 26 of the outer piece 24 of the telescoping horizontal post member 20 and slidably engaged with anyone orifice 26 of the plurality of orifices 26 of the inner piece 22 of the telescoping horizontal post member 20, wherein each locking pin 28 has an aperture 30 traversing through each locking pin 28.

An optional pair of locks 32 may be added to the device in which the optional each lock 32 is attached to the aperture 30 of each locking pin 28.

An optional pair of spacer washers 34 may be added to the device in which the optional pair of spacer washers 34 is attached to the telescoping horizontal post member 20.

An optional letterbox 36 may be added to the device in which the optional letterbox 36 is attached to the telescoping horizontal post member 20.

An optional pair of screws 38 may be added to the device in which the optional pair of screws 38 attached to the telescoping horizontal post member 20 and attached to the letterbox 36.

The telescoping horizontal post member 20 and the telescoping vertical post member 12 may be made of any commercially available material. One preferred configuration of the composition of the telescoping horizontal post member 20 and the telescoping vertical post member 12 is that they are made of plastic selected from the group consisting of rubber, neoprene, nylon, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof. Another preferred configuration of the composition of the telescoping horizontal post member 20 and the telescoping vertical post member 12 is that they are made of metal selected from the group consisting of steel, aluminum, brass, bronze, nickel, iron, manganese, titanium, tungsten, and copper. Still another preferred configuration of the composition of the telescoping horizontal post member 20 and the telescoping vertical post member 12 is that they are wood selected from the group consisting of maple, oak, ironwood, elm, ash, cedar, fir, pine, poplar, ebony, ash, and hemlock 32. The exact dimensions of the telescoping horizontal post member 20 and the telescoping vertical post member 12 may be made of any size. One preferred configuration is that the telescoping vertical post member 12 can extend in length from about four feet to about six feet. Another preferred configuration is that the telescoping horizontal post member 20 can extend in length from about two feet to about four feet.

One preferred embodiment of a kit for a mailbox support structure device 10, the kit comprising: a telescoping vertical post member 12 having an inner part 14 slidably engaged with an outer part 16; a telescoping horizontal post member 20 attachable to the telescoping vertical post member 12, the telescoping horizontal post member 20 having an inner piece 22 slidably engaged with an outer piece 24; and a pair of locking pins 28, each locking pin 28 having an aperture 30 traversing through each locking pin 28.

An optional pair of locks 32 may be added to the kit in which each lock 32 is attachable to the aperture 30 of each locking pin 28.

An optional pair of spacer washers 34 may be added to the kit in which the optional pair of spacer washers 34 is attachable to the telescoping horizontal post member 20.

An optional letterbox 36 may be added to the kit in which the optional letterbox 36 is attachable to the telescoping horizontal post member 20.

An optional pair of screws 38 may be added to the kit in which the optional pair of screws 38 is attached to the telescoping horizontal post member 20 and attached to the letterbox 36.

One preferred embodiment of a method of using a kit for a mailbox support structure device 10, the method comprising the steps of adjoining, affixing, boring, cutting, digging, drilling, enlarging, expanding, inserting, locking, obtaining, piercing, placing, pouring, screwing, and slipping. The obtaining step comprises obtaining a kit comprising a telescoping vertical post member 12 having an inner part 14 slidably engaged with an outer part 16; a telescoping horizontal post member 20 attachable to the telescoping vertical post member 12, the telescoping horizontal post member 20 having an inner piece 22 slidably engaged with an outer piece 24; a pair of locking pins 28, each locking pin 28 having an aperture 30 traversing through each locking pin 28; a pair of locks 32, each lock 32 is attachable to the aperture 30 of each locking pin 28; a pair of spacer washers 34 attachable to the telescoping horizontal post member 20; a letterbox 36 attachable to the telescoping horizontal post member 20; and a pair of screws 38 attached to the telescoping horizontal post member 20 and attached to the letterbox 36. The drilling step comprises drilling a plurality of holes 18 entirely through the inner part 14 of the telescoping vertical post member 12. The cutting step comprises cutting at least one hole 18 entirely through the outer part 16 of the telescoping vertical post member 12. The boring step comprises boring a plurality of orifices 26 entirely through the inner piece 22 of the telescoping horizontal post member 20. The piercing step comprises piercing at least one orifice 26 entirely though the outer piece 24 of the telescoping horizontal post member 20. The digging step comprises digging a trench. The placing step comprises placing one end of the telescoping vertical post member 12 into the trench. The step comprises pouring concrete 40 into the hole 18 when the one end of the telescoping vertical post member 12 is placed into the trench. The affixing step comprises affixing the telescoping horizontal post member 20 to the telescoping vertical post member 12. The adjoining step comprises adjoining the pair of spacer washers 34 to the telescoping horizontal post member 20. The screwing step comprises screwing the pair of screws 38 through the letterbox 36 and through the pair of spacer washers 34 and into the horizontal post member 20. The enlarging step comprises enlarging slidably the telescoping vertical post member 12 to a desired height. The expanding step comprises expanding slidably the telescoping horizontal post member 20 to a desired length. The slipping step comprises slipping slidably one of the locking pins 28 into the pierced orifice 26 of the outer piece 24 of the telescoping horizontal post member 20 and into anyone orifice 26 of the orifices 26 bored entirely through the inner piece 22 of the telescoping horizontal post member 20. The inserting step comprises inserting slidably another of the locking pins 28 into the cut hole 18 of the outer part 16 of the telescoping vertical post member 12 and into anyone hole 18 of the plurality of holes 18 drilled entirely through the inner part 14 of the telescoping vertical post member 12. The locking step comprises locking each lock 32 to the aperture 30 of each locking pin 28.

An optional additional set of steps may be added to the above method further comprising the steps of: adjusting, aligning, disengaging, putting, unlocking, weatherproofing, and withdrawing. The unlocking step comprises unlocking each lock 32*ed* lock 32 from the aperture 30 each locking pin 28. The withdrawing step comprises withdrawing slidably one of the locking pins 28 from the orifice 26 of the outer piece 24 of the telescoping horizontal post member 20 and from anyone orifice 26 of the orifices 26 bored entirely through the inner piece 22 of the telescoping horizontal post member 20. The aligning step comprises aligning slidably the telescoping horizontal post member 20 to a new desired length. The disengaging step comprises disengaging slidably another of the locking pins 28 from the hole 18 of the outer part 16 of the telescoping vertical post member 12 and from anyone hole 18 of the plurality of holes 18 drilled entirely through the inner part 14 of the telescoping vertical post member 12. The adjusting step comprises adjusting slidably the telescoping vertical post member 12 to a new desired height. The putting step comprises putting an envelope in the letterbox 36. The weatherproofing step comprises weatherproofing the device 10 by coating the device 10 with paint.

As to the manner of usage and operation of the present invention, the same should be apparent from the above description. Accordingly, no further discussion relating to the manner of usage and operation will be provided.

While a preferred embodiment of the mailbox support structure device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A mailbox support structure device comprising:

a telescoping vertical post member having an inner part slidably engaged with an outer part, said telescoping vertical post member having a plurality of holes traversing entirely through said inner part and having at least one hole traversing entirely through said outer part of said telescoping vertical post member;

a telescoping horizontal post member attached to said telescoping vertical post member, said telescoping horizontal post member having an inner piece slidably engaged with an outer piece, said telescoping horizontal post member having a plurality of orifices traversing entirely through said inner piece and having at least one orifice traversing entirely through said outer piece of said telescoping horizontal post member;

a pair of locking pins, one of said locking pins slidably engaged with said hole of said outer part of said telescoping vertical post member and slidably engaged with any one hole of said plurality of holes in said inner part of said telescoping vertical post member, another of said locking pins slidably engaged with said orifice of said outer piece of said telescoping horizontal post member and slidably engaged with anyone orifice of said plurality of orifices of said inner piece of said telescoping horizontal post member, wherein each locking pin having an aperture traversing through each locking pin; and a pair of padlocks, each padlock attached to said aperture of each locking pin letterbox is attached to said telescoping horizontal post member.

2. The device of claim 1 further comprising a pair of spacer washers attached to said telescoping horizontal post member.

3. The device of claim 1 further comprising a pair of screws attached to said telescoping horizontal post member and attached to said letterbox.

4. The device of claim 1 wherein said telescoping horizontal post member and said telescoping vertical post member are made of plastic.

5. The device of claim 4 wherein said plastic is selected from the group consisting of rubber, neoprene, nylon, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

6. The device of claim 1 wherein said telescoping horizontal post member and said telescoping vertical post member are made of metal.

7. The device of claim 6 wherein said metal is selected from the group consisting of steel, aluminum, brass, bronze, nickel, iron, manganese, titanium, tungsten, and copper.

8. The device of claim 1 wherein said telescoping horizontal post member and said telescoping vertical post member are made of wood.

9. The device of claim 8 wherein said wood is selected from the group consisting of maple, oak, ironwood, elm, ash, cedar, fir, pine, poplar, ebony, ash, and hemlock.

10. The device of claim 1 wherein said telescoping vertical post member can extend in length from about four feet to about six feet.

11. The device of claim 1 wherein said telescoping horizontal post member can extend in length from about two feet to about four feet.

12. A kit for a mailbox support structure device, said kit comprising:

a telescoping vertical post member having an inner part slidably engaged with an outer part;

a telescoping horizontal post member attachable to said telescoping vertical post member, said telescoping horizontal post member having an inner piece slidably engaged with an outer piece;

a pair of locking pins, each locking pin having an aperture traversing through each locking pin; and a pair of padlocks, each padlock attached to said aperture of each locking pin letterbox is attachable to said telescoping horizontal post member.

13. The kit of claim 12 further comprising a pair of spacer washers attachable to said telescoping horizontal post member.

14. The kit of claim 12 further comprising a pair of screws attached to said telescoping horizontal post member and attached to said letterbox.

* * * * *